United States Patent [19]

Nagata

[11] Patent Number: 4,487,553

[45] Date of Patent: Dec. 11, 1984

[54] JET PUMP

[76] Inventor: Fumio Nagata, 8-14, Mikuni 1-chome, Toyonaka-shi, Osaka 561, Japan

[21] Appl. No.: 455,521

[22] Filed: Jan. 3, 1983

[51] Int. Cl.[3] ..... F04F 5/42; F04F 5/46

[52] U.S. Cl. ..... 417/171; 417/163; 417/179; 417/196; 417/197; 417/198

[58] Field of Search ..... 417/169, 171, 177, 179, 417/180, 196, 197, 198

[56] References Cited

U.S. PATENT DOCUMENTS

| | | | |
|---|---|---|---|
| 284,962 | 9/1883 | Huston | 417/198 X |
| 1,005,108 | 10/1911 | Eliel | 417/179 |
| 1,222,274 | 4/1917 | Farrer | 417/198 X |
| 1,228,608 | 6/1917 | Scanes | 417/197 X |
| 1,421,844 | 7/1922 | Schmidt | 417/174 X |
| 1,942,048 | 1/1935 | Clark | 417/196 X |
| 2,164,263 | 6/1939 | Wall | 417/198 X |
| 2,673,125 | 3/1954 | Squire, Jr. | 417/179 X |
| 2,786,651 | 3/1957 | Mickle | 417/179 X |
| 3,010,232 | 11/1961 | Skakel et al. | 417/87 X |
| 3,457,863 | 7/1969 | Carter | 417/179 X |
| 3,829,247 | 8/1974 | Edmonson | 417/196 X |
| 3,857,651 | 12/1974 | Bruno | 417/171 |
| 4,135,861 | 1/1979 | Brown et al. | 417/183 |
| 4,183,722 | 1/1980 | Roeder | 417/172 |
| 4,274,812 | 6/1981 | Elvidge et al. | 417/179 |
| 4,285,638 | 8/1981 | Clark | 417/172 |
| 4,400,138 | 8/1983 | Baer | 417/179 |
| 4,419,074 | 12/1983 | Schuetz | 417/196 X |

FOREIGN PATENT DOCUMENTS

| | | | |
|---|---|---|---|
| 233560 | 4/1911 | Fed. Rep. of Germany | 417/179 |

*Primary Examiner*—Edward K. Look
*Assistant Examiner*—Paul F. Neils
*Attorney, Agent, or Firm*—Wenderoth, Lind & Ponack

[57] ABSTRACT

A Jet pump for transporting fluid by drawing in the fluid through utilization of a jet stream under high pressure includes a path for transporting the fluid, a plurality of nozzles surrounding the path for supplying high pressure fluid and a plurality of outlets surrounding the nozzles for supplying low pressure fluid.

3 Claims, 7 Drawing Figures

1
2
3
4
5
6
7
8
9
10
11
12
13
14
15
16
17
18
19
20
21
28
48

17
18
21
22
23

JET PUMP

BACKGROUND OF THE INVENTION

1. Field of the Invention

The present invention generally relates a pump, and more particularly to a jet pump for transporting fluids such as liquid, gas or gravel, mud, waste matter and the like by sucking or drawing in such fluids through utilization of jet streams under high pressure.

2. Description of the Prior Art

In prior art arrangements for transporting fluids at high velocity, it has been a general practice to cause nozzle tips to project into a transport pipe so as to carry the fluids through the interior of the transport pipe by a jet stream under high pressure produced from the nozzle tips. In the conventional technique as described above, however, cavitation tends to be generated by the jet stream under high pressure discharged from the nozzle tips, thus resulting in a heavy damage to the nozzle tips in some cases. Meanwhile, with respect to the nozzle tip as described above, since the nozzle is provided at a bent portion of the transport pipe so as to be directed towards the front in the direction of transportation, there has occurred the problem that solids are likely to be clogged within the transport pipe in the case where the fluids to be dealt with include such solid matter.

Accordingly, it is a primary object of the present invention to provide an improved jet pump which is capable of preventing formation of undesirable cavitations.

Another important object of the present invention is to provide a jet pump of the above described type which is so arranged that solids may not produce blockages within the transport pipe.

A further object of the present invention is to provide a jet pump of the above described type which may be applied to a transport pipe with a large diameter.

SUMMARY OF THE INVENTION

To accomplish the foregoing objectives, there is provided a jet pump for transporting fluid by drawing the fluid in through utilization of a jet stream under high pressure. The jet pump comprises a path for transporting the fluid, high pressure fluid supplying means having a plurality of nozzles surrounding the path for supplying high pressure fluid through the nozzles, and low pressure fluid supplying means having a plurality of outlets surrounding the nozzles for supplying low pressure fluid through the outlets. Each nozzle comprises a supply port for injecting high pressure fluid and a nozzle hole for blowing out the high pressure fluid. The supply port and nozzle hole have a common axis which is inclined by an angle $\alpha$ radially inwardly in the direction of transportation with respect to a straight line parallel to the axis of the path and which is displaced by an angle $\beta$ with respect to a plane passing through the axis of the path. The nozzle holes are formed and spaced in a circumferential direction and have an axis which is coaxial with the axis of the outlets of the low pressure supplying means formed and spaced in a circumferential direction and with the axis of the path.

According to the another embodiment of the invention, the jet pump comprises a path for transporting the fluid, and high pressure fluid supplying means having a plurality of nozzles surrounding the path for supplying high pressure fluid through the nozzles. Each nozzle comprises a supply port for injecting high pressure fluid and a nozzle hole for blowing out the high pressure fluid. The supply port and nozzle hole have a common axis which is inclined by an angle $\alpha$ radially inwardly in the direction of transportation with respect to a straight line parallel to the axis of the path, and which is displaced by an angle $\beta$ with respect to a plane passing through the axis of the path.

According to further preferred embodiment of the invention, the jet pump comprises a path for transporting the fluid, high pressure fluid supplying means having a plurality of nozzles surrounding the path for supplying high pressure fluid through the nozzles, and low pressure fluid supplying means having a plurality of outlets surrounding the nozzles for supplying low pressure fluid through the outlets. The high pressure fluid supplying means includes a pump provided close to the nozzles.

According to the present invention, the formation of undesirable cavitations is prevented. Also, solids may not produce blockages within the transport pipe. In addition, the jet pump may be applied to a transport pipe with a large diameter.

DETAILED DESCRIPTION OF THE PREFERRED EMBODIMENT

Figure 1:
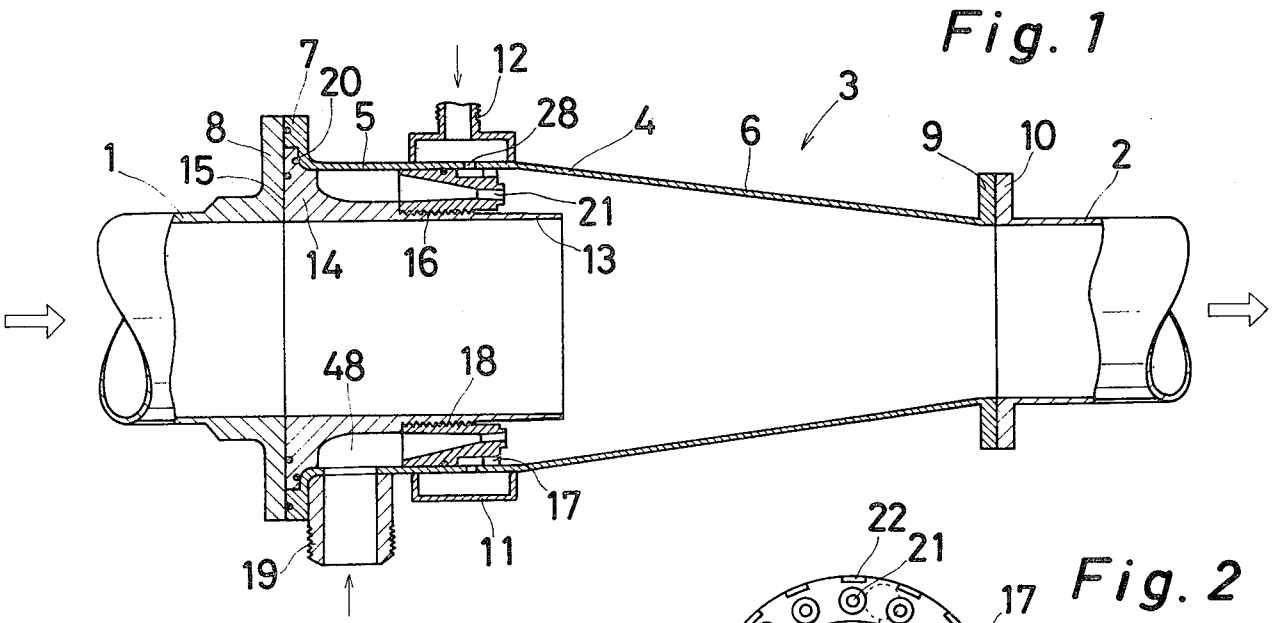
FIG. 1 is a longitudinal sectional view of a jet pump according to one preferred embodiment of the present invention.

Referring now to the drawings, there is shown in FIG. 1 a cross section of an arrangement according to one preferred embodiment of the present invention. In the arrangement of FIG. 1, fluids such as liquid, gas gravel, mud or waste matter, etc. from a transport pipe 1 are transported towards a transport pipe 2 by a jet pump 3 according to the present invention. The jet pump 3 includes an outer pipe 4 having a straight linear axis and formed by a right cylindrical portion 5 and a conical portion 6. The right cylindrical portion 5 is formed, at its free end, with a flange 7, which is to be connected to a corresponding flange 8 formed on the transport pipe 1, while another flange 9 formed at one end of the conical portion 6 is coupled with a mating flange 10 which is formed on the corresponding end of the transport pipe 2. Around the outer periphery of the right cylindrical portion 5, at position close to the conical portion 6, is a header 11 having an endless annular configuration. Header 11 is open to the atmosphere through a connection port 12. Within the outer cylinder and in coaxial relation therewith is an inner piper 13 said. A flange 14 formed at one end of inner pipe 13 is held between the flanges 7 and 8 and is fixed through O rings 15 and 20 so as to be air-tight with respect to the atmosphere. The inner pipe 13 has the same inner diameter as that of the transport pipe 1, and is provided with an external thread 16 formed at approximately a central portion in the axial direction thereof. The external thread 16 is engaged with an internal thread 18 formed in a nozzle forming member 17. To a space 48 defined by the rear end portion (i.e. the leftward end portion in FIG. 1) of the nozzle forming member 17, the outer peripheral surface of the inner pipe 13 and the inner peripheral surface of the right cylindrical portion 5 of the outer pipe 4, liquid or gas under high pressure is supplied through a connection port 19.

Figure 2:
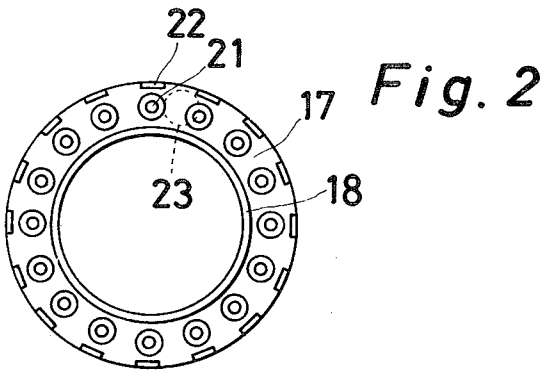
FIG. 2 is a front elevational view showing a nozzle forming member of FIG. 1.

Reference is made to FIG. 2 showing a front elevational view of the nozzle forming member 17 as viewed from the right side in FIG. 1. The nozzle forming member 17 in FIG. 2 has a plurality of nozzle holes 21 formed in a circumferential direction at equal intervals. Radially outwardly of each nozzle hole 21 there is formed a corresponding notch 22 in the outer periphery of member 17.

Figure 3:
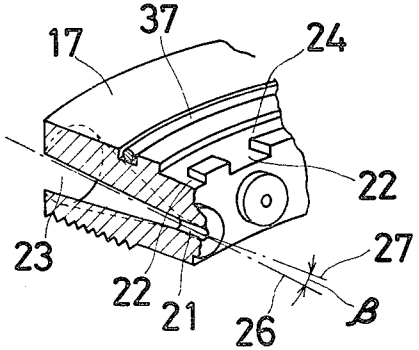
FIG. 3 is a cross sectional view showing, on an enlarged scale, a portion in the vicinity of a nozzle hole.

Referring to FIG. 3, showing a cross section of part of the nozzle forming member, at the rear end side of each nozzle hole 21 of the nozzle forming member 17 and in communication with such nozzle hole 21 is a supply port 23 having a concial configuration. The notches 22 communicate with an annular groove 24 which is provided in the outer periphery of nozzle forming member 17.

Figure 4:
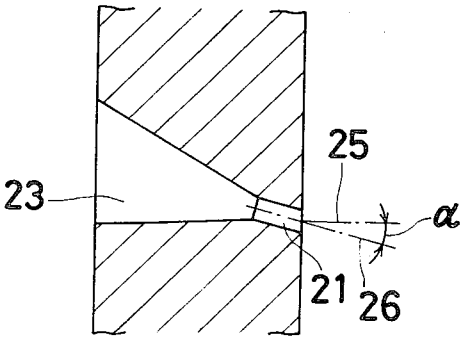
FIG. 4 is a cross section as viewed from a sectional line passing through an axis of the nozzle forming member.

Referring further to FIG. 4 showing a cross section of the nozzle hole 21 and the supply port 23 on an enlarged scale, a common axis 26 of port 23 and nozzle hole 21 is arranged to be inclined by an angle $\alpha$ radially in the direction of transportation, with respect to a straight line 25 parallel to the axis of the nozzle forming member 17. Accordingly, the fluid under high pressure within the space 48 is discharged inwardly in the radial direction of the conical portion 6 of the outer pipe 4 from the supply port 23 through the nozzle hole 21. Also, as shown in FIG. 3, the common axis 26 of the nozzle hole 21 and the supply port 23 is displaced by an angle $\beta$ with respect to a plane passing through a straight line 27 and the axis of the nozzle forming member 17, whereby the jet stream from the nozzle hole 21 is fed into the supply pipe 2, while swirling spirally within the conical portion 6. The annular groove 24 is communicated with the header 11 through a plurality of communication holes 28 (FIG. 1) formed in the right cylindrical portion 5 of the outer pipe 4.

Figure 5:
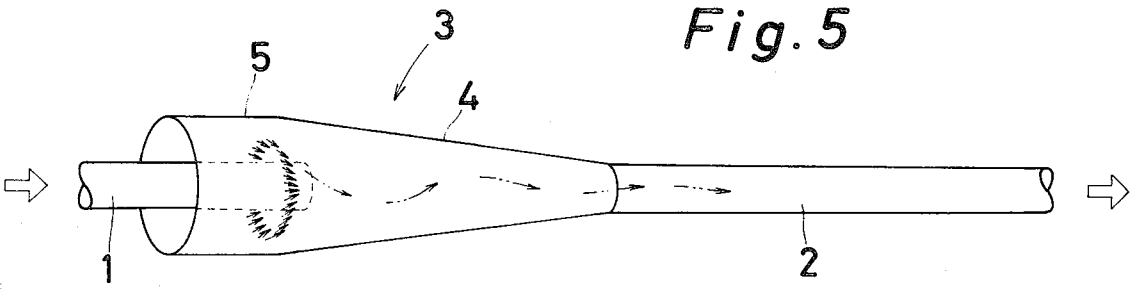
FIG. 5 is a diagram illustrating the flow of fluid from one transport pipe to another transport pipe.

In the arrangement as described above, by supplying the fluid, such as liquid or gas, under high pressure through the connection port 19, the fluid matter from the transport pipe 1 will be drawn in and supplied into the transport pipe 2 at high speed together with the jet stream from the nozzle holes 21. Meanwhile, by discharging the jet stream under high pressure from the nozzle holes 21, a pressure difference is produced in the vicinity of the interior of the conical portion 6 of the outer pipe 4, by this pressure difference, the atmosphere, i.g. air, from the connection port 12 is drawn into the conical portion 6 from the header 11 through the annular groove 24 and via the notches 22. The air thus introduced circulates around the jet stream, and thus, generation of undesirable cavitations is advantageously prevented. Therefore, the jet stream from the nozzle holes 21 advances through the conical portion 6 still at the high speed while swirling spirally as shown in FIG. 5, without any turbulence in its configuration at the time of discharge. Since the axes of the transport pipes 1 and 2 and the outer pipe 4 are in alignment, the fluid matter is transported at high speed without producing any pressure loss. Moreover, owing to the arrangement that the axes of pipes 1, 2 and 4 are calinear as described earlier, even if the fluid matter contains solids therein, it can be fed from the transport pipe 1 to the side of the transport pipe 2, without clogging resulting from such solids.

Figure 7:
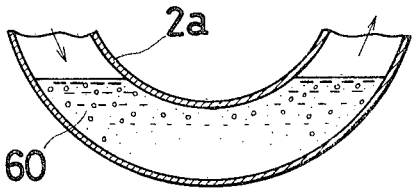
FIG. 7 is a cross sectional view explanatory of action of air.

In the case where the fluid to be supplied from the connection port 12 is air, advantages as follows may be achieved, due to the fact that a layer of air is formed on the inner peripheral surface of the outer pipe 4:

(a) cavitation is prevented as stated earlier, (b) the air layer functions as a lubricant for allowing the fluid matter transported through the transport pipe 1 to contact the inner peripheral surface of the outer pipe 6 at a small frictional force, and (c) in the case where a portion 2*a* of the transport pipe 2 is bent generally in U-shape (FIG. 7) in which fluid matter 60 such as gravel, mud, etc. is settled, air is compressed within fluid matter 60 so as to break the settled state thereof, whereby such fluid matter is prevented from settling and readily may be washed away in the downstream direction.

The jet stream from the large number of nozzle holes 21 is formed into a convergent configuration due to the angles $\alpha$ and $\beta$, and the portion of such jet stream having the smallest configuration coincides with the vicinity of a junction between the conical portion 6 and the transport pipe 2.

By the above arrangement in which the jet stream transports the fluid matter while swirling, advantages as follows can be available:

(a) fluid matter at a large flow rate is drawn in so as to flow easily, (b) solids contained in the fluid matter from the transport pipe 1 are moved to the vicinity of the axis, i.e. towards the central portion, whereby flowing of the fluid matter is facilitated, and thus, since the solids do not contact the inner peripheral surfaces of the conical portion 6 and the transport pipe 2, such inner peripheral surfaces are prevented from being damaged, and further, (c) even when a rod-like member such as a wood piece or the like is introduced from the transport pipe 1, such rod-like member is transported from the transport pipe 1 to the transport pipe 2 while aligned in a direction parallel to the axis of the outer pipe 4, and therefore, it is possible for the rod-like member to flow with almost no contact with the inner peripheral surfaces of the outer pipe 4 and the transport pipe 2.

Fluids such as liquid, gas, etc. may be supplied into the connection port 12 under comparatively low pressure. Moreover, it may be so arranged that, with a flow rate control valve installed between the connection ports 12 and 19, the flow rate of the fluids to be fed into connection ports 12 and 19 is controlled to achieve optimum conditions.

A plurality of jet pumps of the present invention as described in the foregoing can be connected in series to the transport pipe for increasing the transport pressure and for transport of fluid matter over a long distance.

Figure 6:
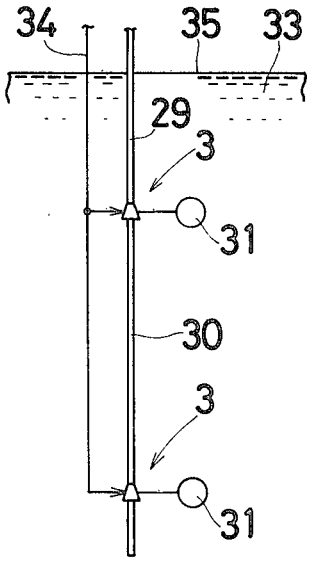
FIG. 6 is a diagram showing the state of use of the jet pump.

Referring further to FIG. 6, in the case where mud or the like is to be sucked or pumped up from a sea bottom, a plurality of the jet pumps 3 according to the present invention may be disposed between the transport pipes 29 and 30. To each of the above jet pumps 3, sea water is supplied under high pressure through the connection port 19 into the space 48 by an electric pump 31. Air under a sufficient pressure is forced into the connection port 12 through a common duct 34 so that air is introduced into the conical portion 6, without a counterflow of sea water into the connection port 12 in a deep sea.

In the construction as described above, the power line for energizing the electric pump 31 has only to be provided along the transport pipes 29 and 30, and since there is no necessity for supplying fluid under high pressure into the jet pump 3, the operations required therefor are much facilitated. Furthermore, all that is required by the electric pump 31 is to raise the pressure of the sea water by the head corresponding to the capacity of the electric pump 31 from the position where the jet pump 3 is installed, irrespective of depth of the level 35 of the sea water 33, and therefore, it is not necessary to unreasonably increase the capacity of the electric pump 31.

It should be noted here that air to be supplied through the connection port 12 may be replaced by other gases or liquids under low pressure to be fed into connection port 12.

As is clear from the foregoing description, according to the present invention, since the outer pipe has an axis in the form of a straight line, there is no possibility of clogging even when solids are contained in the fluid matter to be transported. Furthermore, owing to the arrangement that fluid under low pressure surrounds the outer portion in the radial direction of the jet stream under high pressure, the formation of any undesirable cavitations may be advantageously prevented. Moreover, due to the fact that the nozzle holes are dispersed in the circumferential direction, it is possible to cope with transport pipes with large diameters.

What is claimed is:

1. A jet pump for transporting a fluid in a linear direction, said jet pump comprising:

an outer pipe including an upstream cylindrical portion, adapted to be connected to a first transport pipe from which a fluid is to be pumped, and a downstream conical portion, adapted to be connected to a second transport pipe to which fluid is to be pumped;

an inner pipe coaxially positioned within said outer pipe, said inner pipe having therethrough a cylindrical passage having an inlet end adapted to receive the fluid from the first transport pipe and an outlet end adapted to discharge the fluid into the interior of said conical portion, said inner pipe having adjacent said inlet end an outwardly extending flange sealed to said cylindrical portion, and said inner pipe having external threads;

means for drawing fluid through said passage in said inner pipe, said drawing means comprising an annular nozzle forming member threaded onto said external threads and positioned coaxially between said cylindrical portion of said outer pipe and said inner pipe, said nozzle forming member having therein a plurality of circumferentially spaced supply ports and a plurality of circumferentially spaced nozzle holes, each said nozzle hole extending from a respective said supply port and opening in a downstream direction at a position outwardly of said inner pipe, each said supply port and the respective said nozzle hole having a common axis which is inclined radially inwardly in a downstream direction at a first angle with respect to a first straight line extending parallel to the axis of said nozzle forming member and which is displaced by a second angle with respect to a plane passing through a second straight line extending parallel to said axis of said nozzle forming member and through said axis, said first angles of all of said common axes being equal, and said second angles of all of said common axes being equal, and means for supplying a high pressure fluid to said plurality of supply ports, such that said high pressure fluid is discharged from said plurality of nozzle holes as a plurality of spirally swirling jets, thereby drawing the fluid through said cylindrical passage in said inner pipe; and means for forming a fluid layer around said jets and the fluid and thereby for preventing cavitation by said jets, said cavitation preventing means comprising an annular header positioned about said cylindrical portion of said outer pipe and connected to a source of layer-forming fluid, an annular groove formed in the outer periphery of said nozzle forming member and connected to said header, and a plurality of circumferentially spaced notches formed in the outer periphery of said nozzle forming member, each said notch being positioned radially outwardly of a respective said nozzle hole, and each said notch extending from said annular groove in a direction parallel to said axis of said nozzle forming member and opening into the interior of said conical portion, whereby said jets discharged from said nozzle holes draw in said layer-forming fluid through said notches, thus forming a layer between the interior of said conical portion and said jets and the fluid being transported.

2. A jet pump as claimed in claim 1, further comprising holes extending through said cylindrical portion of said outer pipe and connecting said header to said annular groove.

3. A jet pump as claimed in claim 1, wherein said drawing means further comprises an annular space defined by upstream surfaces of said nozzle forming member, an outer peripheral surface of said inner pipe, and an inner peripheral surface of said cylindrical portion of said outer pipe.

* * * * *